US005275101A

United States Patent [19]

Chemiere et al.

[11] Patent Number: 5,275,101

[45] Date of Patent: Jan. 4, 1994

[54] PYROTECHNIC CHAIN IGNITER FOR CARGO WARHEAD SUBMUNITION

[75] Inventors: Patrice H. Chemiere; Jean-Paul A. Dupuy, both of Bourges; Alain R. Pascal, Saint-Eloy, all of France

[73] Assignee: GIAT Industries, France

[21] Appl. No.: 829,879

[22] Filed: Feb. 3, 1992

Related U.S. Application Data

[63] Continuation-in-part of Ser. No. 559,097, Jul. 30, 1990, Pat. No. 5,206,457.

[30] Foreign Application Priority Data

Aug. 1, 1989 [FR] France ..... 89 10338

[51] Int. Cl.[5] ..... F42C 15/26

[52] U.S. Cl. ..... 102/235; 102/251; 102/233; 102/245; 102/269

[58] Field of Search ..... 102/233, 235, 245, 251, 102/234, 254, 256, 231, 232, 236, 244, 269, 266

[56] References Cited

U.S. PATENT DOCUMENTS

| | | | |
|---|---|---|---|
| 1,563,418 | 12/1925 | Adelman | 102/245 |
| 3,848,531 | 11/1974 | Mellen | 102/245 |
| 4,488,488 | 12/1984 | Looger et al. | 102/396 |
| 4,612,858 | 9/1986 | Backstein et al. | 102/245 |
| 4,811,664 | 3/1989 | Levy et al. | 102/269 |
| 4,998,476 | 3/1991 | Rudenauer et al. | 102/226 |
| 5,022,325 | 6/1991 | Skowasch et al. | 102/245 |

FOREIGN PATENT DOCUMENTS

| | | | |
|---|---|---|---|
| 328749 | 4/1919 | Fed. Rep. of Germany | 102/246 |
| 1121878 | 6/1963 | France | 102/251 |
| 220649 | 5/1968 | Sweden | 102/245 |

*Primary Examiner*—Stephen M. Johnson

*Attorney, Agent, or Firm*—Parkhurst, Wendel & Rossi

[57] ABSTRACT

A pyrotechnic chain igniter device for cargo warhead sub-ammunition including an explosive charge contained in an enclosure, comprising a first striker mobile in a longitudinal bore of a body for striking a primer, a slider carrying the primer, the slider being slidably mounted in a transverse groove in the body and being adapted for sliding between a safety position and an armed position, wherein the safety position is defined by the slider being misaligned with the first striker and the armed position is defined by the primer being substantially aligned with the first striker. The first striker is adapted for striking the primer when the slider is in the armed position and when the sub-ammunition impacts a target. At least one device for blocking the slider in the safety position is provided. A trigger is pivotally mounted to the body, and a spring is provided for maintaining the trigger in a first position to prevent the slider from moving into the armed position, and for allowing the trigger to move to a second position upon axial rotary movement of the sub-ammunition thereby allowing the slider to move into the armed position.

4 Claims, 9 Drawing Sheets

PYROTECHNIC CHAIN IGNITER FOR CARGO WARHEAD SUBMUNITION

The present application is Continuation-In-Part application of prior co-pending U.S. Pat. application Ser. No. 07/559,097, filed Jul. 30, 1990. Prior co-pending application Ser. No. 07/559,097 issued as U.S. Pat. No. 5,206,457 on Apr. 27, 1993.

BACKGROUND OF THE INVENTION AND PRIOR ART

The field of the present invention is that of igniters for cargo warhead submunitions, and in particular for antipersonnel and antivehicle grenades dropped in large numbers from above a target, according to the "saturation" technique. A cargo warhead is a warhead in which the usual explosive charge has been replaced by a large number of submunitions or subprojectiles.

In most cases, the submunitions are grenades consisting of a cylindrical fragmentation body having an antipersonnel effect by projection of shrapnel, and closed at one end by a shaped charge cover to permit the charge to penetrate light or weakly armed vehicles through the roof. The other end of the body supports the igniter device that initiates the explosive charge contained in the body.

Ordinarily, these grenades are stacked in several columns inside the cargo warhead, with the igniter device turned toward the base occupying the space left free by the shaped charge cover of the next grenade, or is fitted into a form arranged for this purpose in the base of the cargo warhead.

The grenades are then ejected and dispersed over the warhead trajectory in a dumping phase, with a speed of rotation about their axis that is close to that of the warhead at the time of dumping.

The main technical function of the igniter device is to ignite the main charge primer of the submunition as reliably as possible at the time of its impact, and to prohibit this ignition in cases of low impacts occuring during handling.

The igniter device may also include a specific neutralizing device, i.e. one that prohibits any ignition from normal handling when ignition has not occured after a normal launch.

The constraints to be complied with in solving the technical problem defined above are as follows:

- There is a form and dimensional constraint. This constraint stems from the need to fit the ignition device into the shaped charge cone of the following submunition, as explained above.
- There is then a weight constraint. The igniter device on the rear of the submunition must be as light as possible so that the submunition center of gravity is located as far forward as possible, which favors stability along the trajectory.
- Finally, there is a constraint related to the cargo warhead firing conditions, which is essentially the need to withstand ignition from the very high acceleration when dropped.

The patents U.S. Pat. No. 4,488,488, W08603828, EP0256320, U.S. Pat. No. 4,612,858 and FR2606136 describe various solutions for igniter devices of this type. Ordinarily, the igniter devices described in these patents include igniters consisting of a primer, which a striker, under the effect of its own inertia, strikes at the time of impact.

The reliability of ignition may be complemented by a self-destruct system that is triggered independently of the main igniter, and which causes the submunition to self-destruct by igniting the main charge after a certain delay.

The prevention of ignition during handling is ensured by locks, which are raised only consecutive to a rapid rotation of the submunition. The example of construction closest to the present invention is the third version of the igniter device described in U.S. Pat. No. 4,612,858.

Ordinarily, this igniter device includes a primer arranged in a slider, which a striker strikes at the time of impact, moved by its own inertia. The reliability of the ignition is complemented by a self-destruct mechanism whose ignition is caused by the rotation of the subprojectile.

The prohibition of ignition during simple handling or impacts therefrom stems from the fact that, in storage position, the slider is in such a position that the primer it carries is not in alignment with the rest of the pyrotechnic chain, and is held in this position by the striker as long as the striker is not in an armed position.

This same spring neutralizes the igniter system by placing the slider in a disaligned, locked position if the speed of rotation is inadequate or if the striker does not operate after impact.

The self-destruct system includes a primer integral with the slider and which, under the effect of the centrifugal force, strikes a striker integral with the body of the igniter device. This primer in turn initiates a retarding composition arranged in a groove in the face of a disk placed between the initiation system and the main charge, and presenting an igniter relay in the striker axis that can be initiated either by the main primer or by the retarding composition.

A lateral opening in the primer housing aligns with the retarding composition, allowing its initiation.

This devices exhibits numerous disadvantages. It may first be noted that all of the operating safeties are raised under the action the centrifugal force alone, which is harmful from the point of view of safety.

With respect to the self-destruct device, it can be said that the procedure for loading the retarding composition is not easy. It is difficult to obtain a homogeneous composition, which is necessary for good regularity of combustion and consequently of the delays, which should be reproducible from one igniter device to the next.

It will also be difficult to vary these delays, as the combustion time is directly dependent on the length of the charge, except by modifying this length and therefore the disk, or changing the composition.

Nor is there found in this device any way of interrupting the pyrotechnic chain between the igniter relay and the retarding composition, which is a sensitive element, and this is a serious safety concern.

When the slider carrying the primer is pinched in an intermediate position without the self-destruct device being initiated, the slider will not be in neutralization position, and an accidental initiation is then possible consecutive to manual handling of the grenade after it has fallen on the ground.

Finally, this igniter device consists of a large number of parts, which makes it expensive. In particular, the body is a complex piece of foundry work that is generally made of a zinc alloy, and it provides both the housing for the various parts as well as the attachment and securing of the igniter device on the submunition body.

GENERAL DESCRIPTION OF THE INVENTION

Compared with the construction described above, the present invention concerns an igniter device which, by its design and construction, offers enhanced safety with a reduced number of mechanical parts, while satisfying the contrains related to this type of device, and which were explained above. It also relates to an igniter device including self-destruct means that are more reliable and can be removed, and reliable neutralization means.

This object is generally accomplished according to the present invention by an igniter device of a pyrotechnic chain for the sub-ammunition of a cargo shell comprising an explosive charge contained within a casing, of the type comprising:

a slide mechanism carrying a fuse, the slide mechanism being movable in a transverse groove of a body between a safety position in which the fuse is not aligned with the continuation of the pyrotechnic chain and an armed position in which the alignment is achieved, a striking pin that moves in a longitudinal bore and hits the fuse when the sub-ammunition impacts, at least one device for immobilizing the slide mechanism in its safety position, counterbalancing devices comprising a trigger pivotally mounted to the body, the trigger bring held by a spring in a first position wherein one of its ends forms an obstacle to prevent the slide mechanism from moving to its armed position after the sub-ammunition has been dropped on the ground prevent any subsequent movement of the trigger the trigger being pivotal to a to a second position by action of an axial rotary movement of the sub-ammunition, wherein its end no longer prevents movement of the slide mechanism, the end of the trigger comprising, opposite a second striking pin carried by the slide mechanism, a housing that has a shape that complements that of this second striking pin so that the trigger is trapped when it enters the housing.

This construction has the advantage of blocking the slider in a known position and preventing the firing of the main pyrotechnic chain, and also the firing of any delay chain.

This is because, in the system proposed by the prior art, the neutralization device requires a movement of the slider that will bring the slider into a neutralization position. This is a motion that cannot occur if the slider is blocked.

Such a device avoids the storage of energy inside the device, as the spring is not held in stretched position within the device and is stretched only when the submunition is rotated, which decreases the risk of degrading the spring during storage.

Furthermore the invention concerns an igniter device of a pyrotechnic chain for the sub-ammunition of a cargo shell containing an explosive charge contained within a casing, of the type comprising:

a slide mechanism carrying a fuse the slide mechanism being movable in a transverse groove of a body between a safety position in which the fuse is not aligned with the continuation of the pyrotechnic chain and an armed position in which the alignment is achieved, a striking pin that moves in a longitudinal bore that hits the fuse when the sub-ammunition impacts, at least one device for immobilizing the slide mechanism in its safety position, counterbalancing devices comprising a trigger pivotally mounted to the body, the trigger being held by a spring in a first position wherein one of its ends forms an obstacle to prevent the slide mechanism from moving to its armed position after the sub-ammunition has fallen to the ground to prevent any subsequent movement of the trigger the trigger being pivotal to a second position by the action of an axial rotary movement of the sub-ammunition, wherein its end no longer prevents movement of the slide mechanism, the end of the trigger comprising, opposite a second striking pin carried by the slide mechanism, a housing in which the second striking pin may enter and then prevent the trigger from moving away from the slide mechanism.

Other and further advantages and characteristics of the present invention will be understood in reading the following non-limitations description of embodiments taken in conjunction with the accompanying drawings.

DETAILED DESCRIPTION OF PREFERRED EMBODIMENTS

Figure 1:
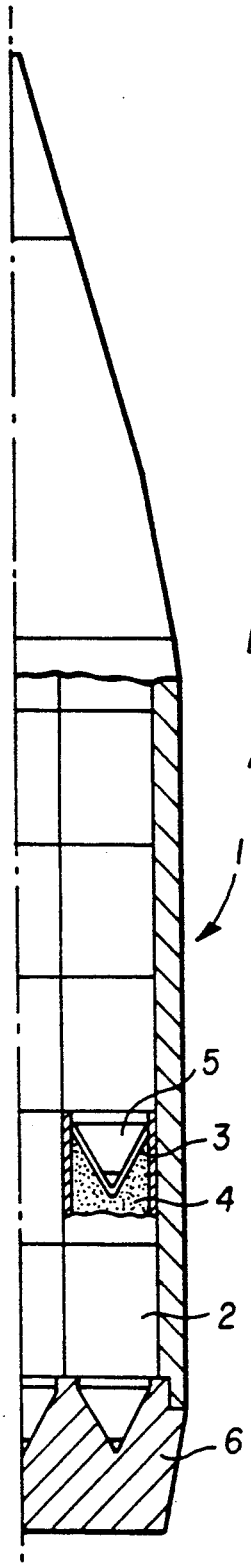
FIG. 1 is a sectional view of a cargo warhead.

The igniter system for cargo warhead submunitions 1 according to the invention is, as explained above, designed to be installed on submunitions 2, a large number of which are housed in this warhead. Each submunition is designed so that the igniter device of one fits into space left free within the cover of the shaped charge of the following submunition. This hollow is shown in detail in FIG. 1, illustrating shaped charge cover 3 of a submunition including an explosive charge 4, within which cover the igniter device 5 of the next submunition is fitted. This figure is intended to illustrate the classical arrangement of submunitions 2 in the warhead, with the igniter system oriented toward the base 6 of the warhead.

Figure 2:
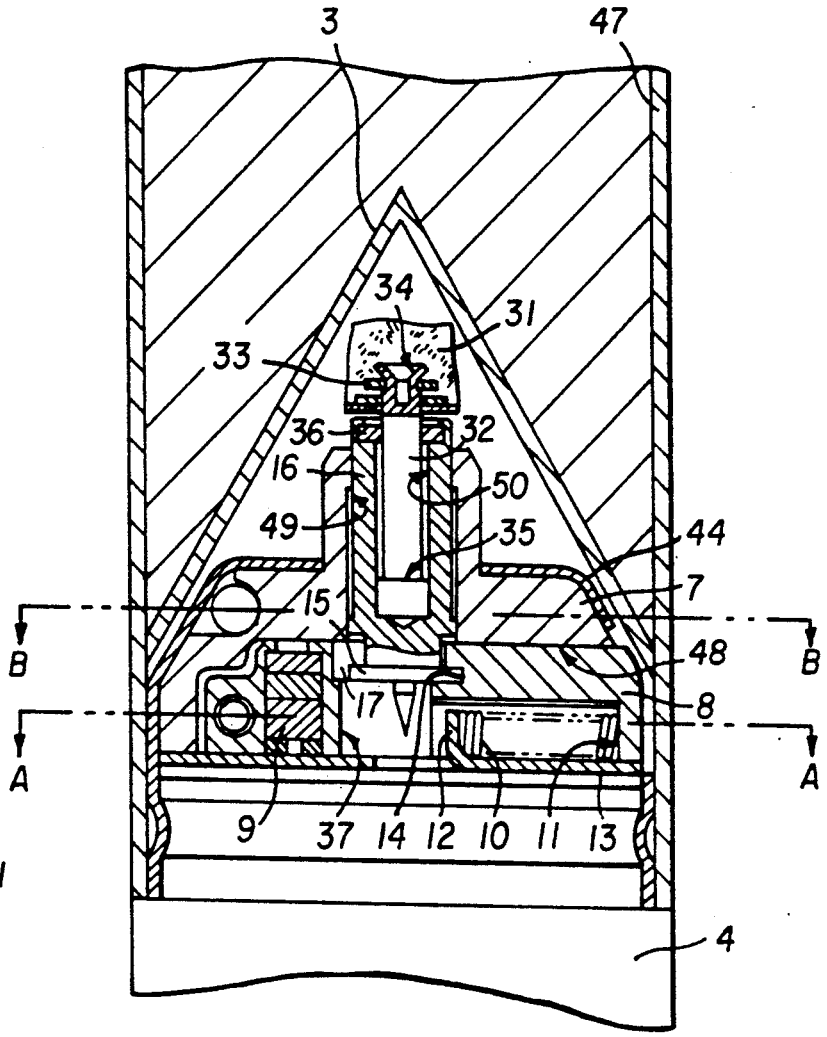
FIG. 2 is a partial longitudinal section of two submunitions in a stack, showing the igniter system according to the invention.

As shown in FIG. 2, the igniter device according to the invention, shown in its safety position, consists of a body 7 arranged inside a metal mask 44 made of stamped metal plate, and whose internal profile matches the external profile of the body 7.

The mask 44 thus covers the body 7, which supports all of the igniter means, the body being held in contact with the mask by a closure disk 13, itself coming to bear on the explosive charge 4.

Figure 7:
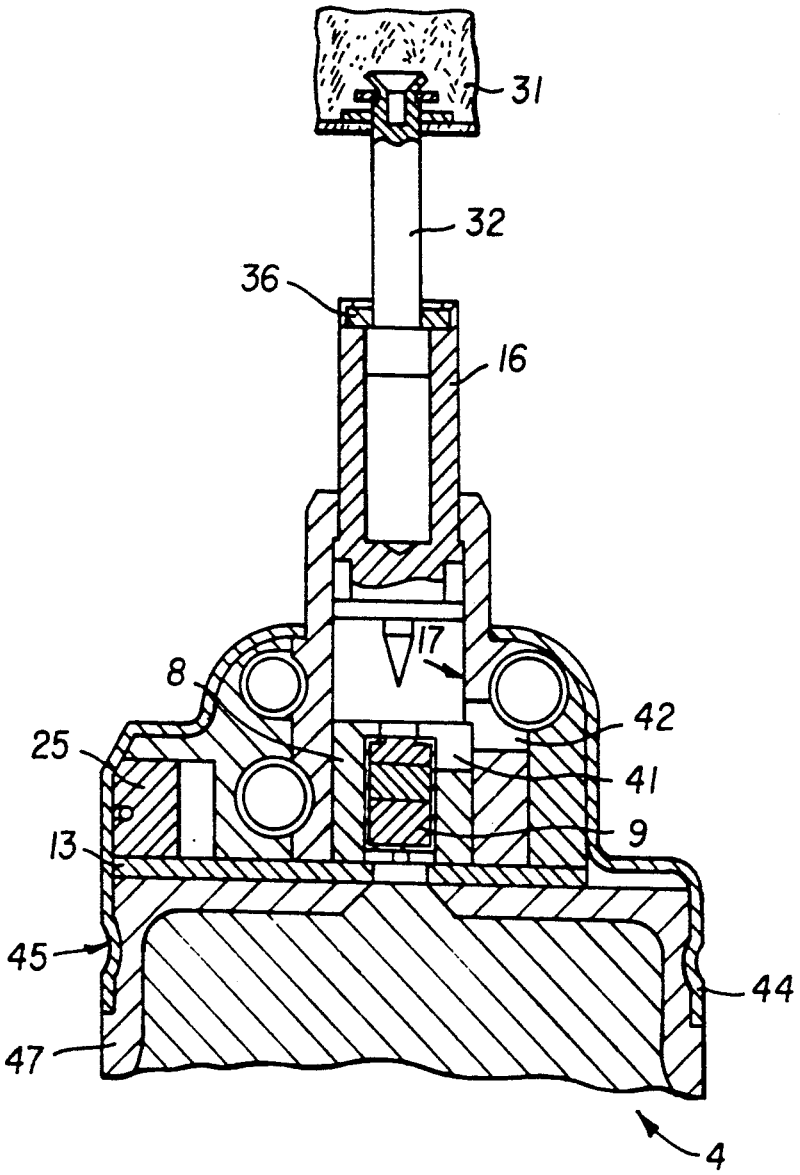
FIG. 7 is the same section as in FIG. 6, with the striker being in armed position.

The mask carrying the igniter device is integrated with the explosive charge by an annular crimping 45 around the metal enclosure 47 of the charge in FIG. 7 but any other mode of connection is possible. The mask constitutes a reinforcement of the body and allows the body to be dimensioned for the use of plastic materials. That is, the forces transmitted during the motions of the submunitions by pieces constituting the igniter device according to the invention will be absorbed by the mask, which is of sufficient rigidity. This avoides having to use a foundry piece of complex profile to manufacture the igniter device.

Inside the body 7 is provided a transverse groove 48 inside of which a slider 8, carrying a primer 9, is slidably mounted. The slider is pushed in its groove by a compression spring 10 bearing on one side against an extremity 11 of an opening provided in the slider, and on the other side on a peg 12 of the closure disk 13 of the body 7.

The body also includes a longitudinal bore 49 inside of which is slidably mounted a striker 16.

Striker 16 includes an axial bore 50 inside of which is arranged a telescoping rod 32 having a shoulder 35 that butts against washer 36, which is integral with the striker 16 by crimping.

A textile tape 31 is connected to the telescoping rod 32 by means of a washer 33 secured by crimping 34.

The striker also carries a collar 15 which, when the device is in safety position, fits into a groove 14 in the slider 8, thereby immobilizing the striker in translation.

Figure 3:
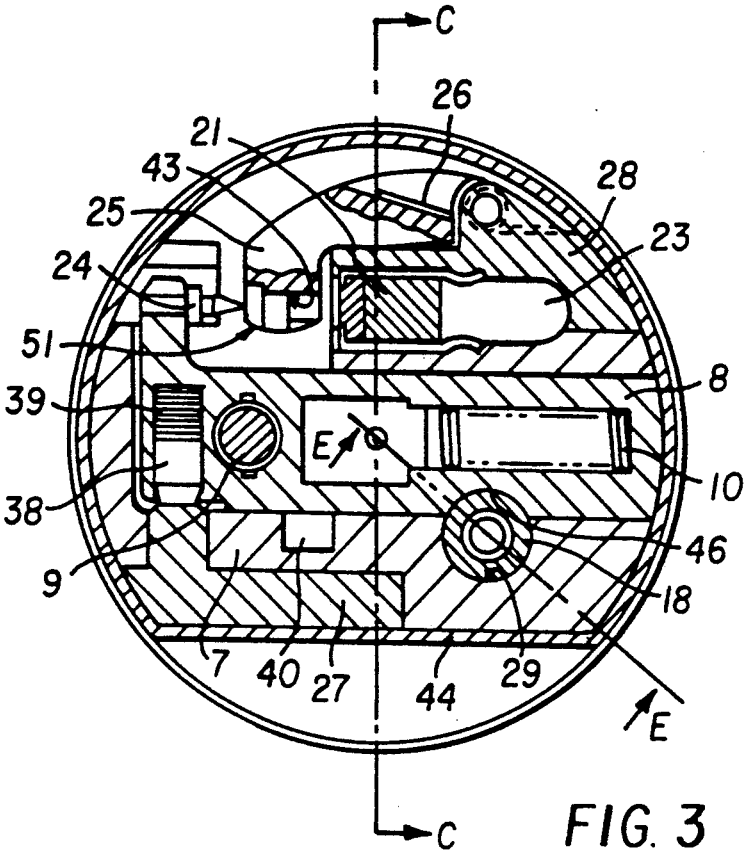
FIG. 3 shows a cross section of a first embodiment of the device, along with a plane A—A of FIG. 2.
Figure 4:
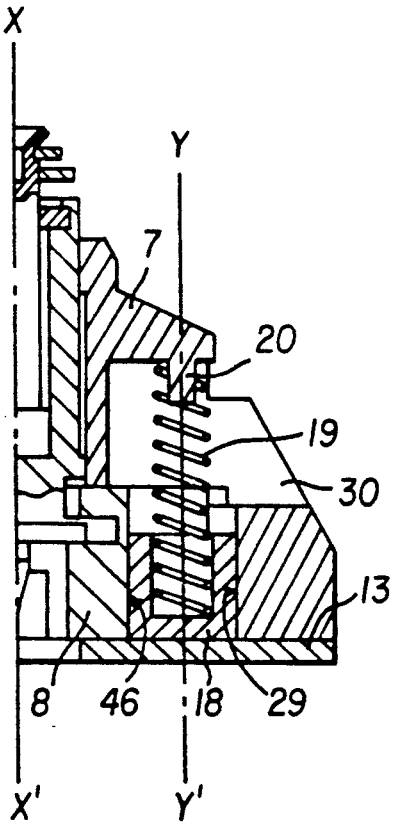
FIG. 4 is a section of the acceleration safety, taken along the plane E—E of FIG. 3.

FIGS. 3 and 4 show a first means of blocking, consisting of a flyweight 18 bearing in opening 29 in body 7, and on an imprint 46 arranged in the slider to block the slider (FIG. 3). The flyweight is held in position by a compression spring 19, adjusted on one side in a blind hole in flyweight 18 and guided on the other side over a short length by a pin 20 integral with the body 7.

In classical fashion, this lock is designed to unlock only in the presence of adequate accelerations and travel of the flyweight (acceleration of the order of 900 G), to prevent accidental unlocking due to normal handling or to dropping during the storage or handling periods.

It will be noted that the flyweight 18, spring 19 and pin 20 are aligned along a line Y-Y' parallel to the longitudinal axis X-X' of the submunition and to the acceleration vector of the projectile when the shot is fired. An opening 30 is arranged in the body 7 all around the line Y-Y' in FIG. 5, for a purpose that will be explained later.

Therefore, before the cargo warhead is fired, any translation of the slider is prohibited by the blocking means.

When the blocking means is retracted and the submunitions are no longer in the cargo warhead (in this case the slider cannot move to armed position since it is bearing on the cover of the shaped charge of the adjacent submunition) a limited translation of the slider is possible until it comes to rest in hollow 17 arranged in the slider on the collar 15, which thereby constitutes a second slider locking means.

The slider is then still immobilized in a safety position, but the collar 15 is removed from the groove 14, allowing translation of the striker.

The slider 8 carries a pin 38 (FIG. 3) that is pushed by a spring 39, arranged to engage in a hole 40 in the body 7 to ensure the locking of the slider in armed position.

Figure 5:
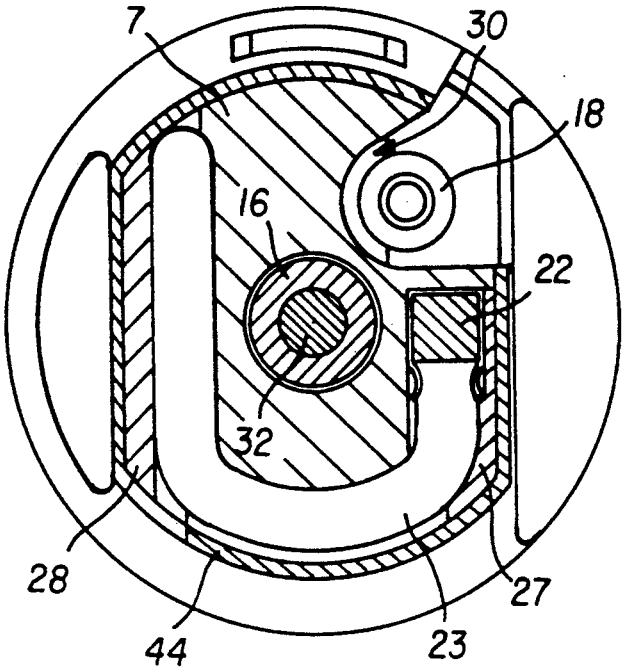
FIG. 5 is a section of the igniter system taken along the plane B—B of FIG. 2.
Figure 6:
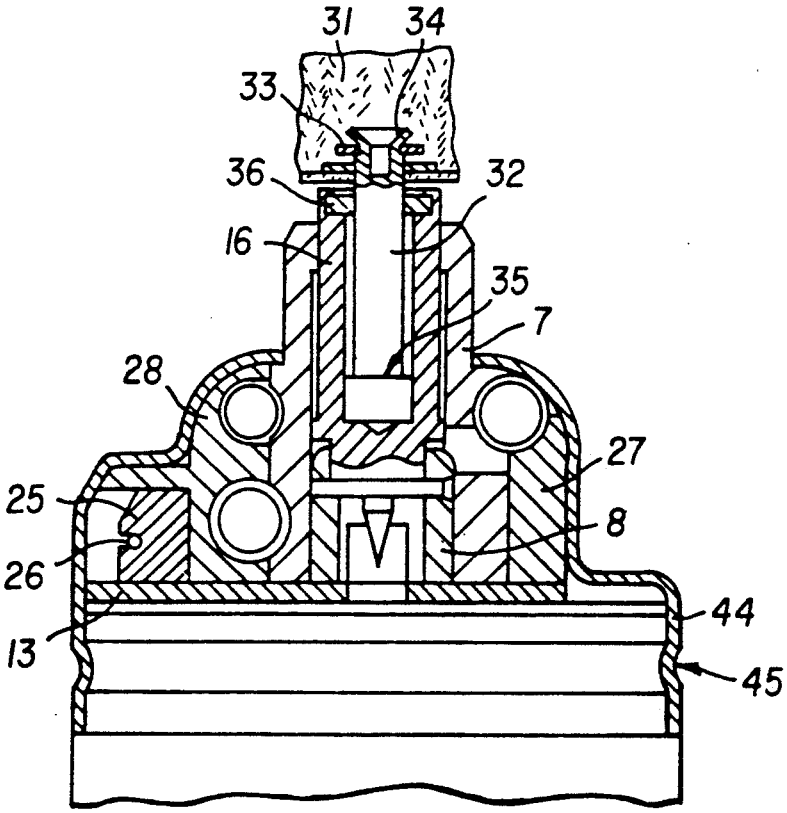
FIG. 6 is a section along plane C—C of FIG. 3.

FIGS. 3, 5 and 6 show a self-destruct device including a striker 24 integral with the slider 8 and a delaying assembly consisting of a primer 21 and an igniter relay 22, crimped on a flexible delay wick 23.

The igniter device according to the invention also includes a neutralization means comprising a centrifugal trigger 25 held in the safety position shown in FIG. 3 by a torsion spring 26, and lodging its free end 51 between the striker 24 and the delay system primer 21, thereby constituting an obstacle preventing the slider from moving to its armed position. The trigger has a hollow 43 on its free end 51 opposite the striker 24, the purpose of which is explained hereafter.

The delaying assembly is fastened outside the body 7 by support pieces 27 and 28, secured to the body 8 by a click-on system that is not shown (see FIGS. 3, 5 and 6).

The device operates as follows.

When the shot is fired, an acceleration and a rotation are imparted to the warhead. By inertia, the flyweight 18 then compresses the spring 19 along the linge Y-Y' and enters the opening 30. As the rotation of the projectile creates a centrifugal force, the flyweight 18 is offset and is trapped across the opening 30.

The offsetting is favored by the small diameter of the spring 19 and by the fact that the very short pin 20 offers practically no guidence. The slider 8 is no longer connected to the body by the flyweight 18 and can then slide slightly, within the limits established by the hollow 17 in the striker 16 and by the pressure of the slider on the cover of the neighboring submunition.

The flyweight 18, once offset, cannot subsequently return to its place, even once the acceleration phase is terminated.

It will be noticed that, as the opening 30 is free through 360° with respect to the line Y-Y' (see FIG. 5), the flyweight 18 will be trapped regardless of the orientation of the submunition in the warhead, no indexation between the submunition and the warhead is needed in the assembly, which simplifies the integration of the submunitions in the cargo warhead.

At the time of dumping, the submunitions are ejected from the warhead with a speed of rotation about their axis that is roughly equal to that of the warhead at the selfsame moment of dumping.

The centrifugal force causes the trigger 25 to pivot and causes the translation of the slider 8, pushed by the spring 10. The collar 15 is then removed from the groove 14 and the striker is free to translate.

It should be noted that the striker 16 is not extracted instantaneously, but this occurs only once the tape 31 is deployed and the rod 32 has come out of its hollow (FIG. 7). This arming delay prevents two submunitions from operating accidentally if they hit each other at the time of dumping.

The tape 31 (FIG. 7) deploys and pulls out the telescoping rod 32, which butts against the washer 36, then extracts the striker 16 from its hollow 17.

The slider then goes to armed position and, at the same time, the striker 24 initiates the self-destruct device. The slider is locked by the pin 38 engaged in the hole 40.

The primer 9 is positioned by the peg 12, against which butts the end 37 of the hollow of spring 10.

During descent, the following occurs:

The attitude of the submunition is controlled by the tape 31, the effectiveness of which is reinforced by telescoping rod 32, which moves rearward the point of application of the braking force imparted by the tape 31, and increases the anti-flip torque.

The rotation of the submunition is braked by an aerodynamic device of known type, not illustrated (e.g. fins integral with the submunition body). The speed of rotation decreases and, with it, the centrifugal force retaining the trigger.

Upon impact, the submunition touches the target on the shaped charge side and is subjected to a very high deceleration at the same time. By inertia, the striker 16 strikes and initiates the primer 9, and thereby the shaped charge 4.

If, however, the fall of the submunition is gradually braked, e.g. by branches retaining the tape 31, the initiation of the charge is still ensured by the self-destruct device.

The primer 21 has lit the delay wick 23, which will initiate the primer 9 by means of the igniter relay 22, and through two openings 41 and 42 provided in the slider 8 and body 7, respectively (FIG. 7).

It will be noted that the self-destruct sequence starts at the time the igniter device reaches armed position, and continues thereafter, regardless of the environmental conditions encountered by the submunition during its freefall, which constitutes an assurance of reliability.

It will also be noted that this self-destruct arrangement can initiate the main charge only if the slider 8 is in armed position, as the opening 41 is then opposite the opening 42.

If disaligned primer 9 is not aligned, the operation of the relay 22 will have no consequences on the main charge, which is advantageous from the point of view of safety.

Moreover, if for any reason the slider 8 cannot slide and therefore the arming does not occur, the submunition would be on the ground, with all of the blocking means out of service, and any person handling it could then release the slider 8 and cause the percussion of the delay.

Such a disadvantage is avoided thanks to the neutralization means proposed by the invention. That is, when the rotation of the submunition has stopped, the trigger 25, pushed by its spring 26, returns to the safety position shown in FIG. 3. It then limits movement of the slider 8, preventing it from moving to armed position and initiating the delay.

It is possible to impart to the hollow 43 and to the trigger 25 a shape such that the return of the said trigger to the safety position is possible regardless of the intermediate position between the storage position and the armed position adopted by the primer-carrying slider.

The shape of the hollow 43 is complementary to that of the striker 24 so that, if the slider is displaced, bringing the striker inside the hollow 43, these elements are irreversibly trapped, which increases the safety of the device in later handling.

FIGS. 8 to 12 illustrate a second embodiment of the igniter device according to the invention, in which the elements analogous to those described above have the same item numbers.

In this particular embodiment, the body 7 is a foundry piece of zinc alloy (Zamac), manufactured for example by the lost wax process. As before, it includes a slider 8 arranged in a transverse groove in the body 7, and held by a closure disk 13 made integral with the body 7 by a means of attachment (screws or rivets) that are not illustrated.

The slider is pushed by the spring 10, which bears on one side on a peg 12 of the disk 13.

In this particular case, and for convenience of assembly, the spring 10 is arranged on a rod 52 so that the spring can be compressed in order to place it in its hollow. A split washer 53 is inserted between the spring 10 and the head of the rod 52 through an opening 54 in the disk 13. This washer therefore integrates the rod 52 with the slider 8.

The striker 16 is slidably mounted in the bore 49. In this variant, it includes no telescoping rod, but still carries the textile tape 31 fastened to the means by a washer 33 held by crimping 34.

The collar 15 of the striker 16 fits into the groove 14 of the slider 8, which thereby immobilizes the striker in translation.

A steel hoop 55 receives the igniter system and is made integral with it by transverse linking means (screws or rivets) that are not illustrated. This hoop is used to integrate the igniter system with the body of the charge (not illustrated here) by means of an annular crimping analogous to the crimping 45 illustrated in FIGS. 6 and 7.

The rotation braking fins 56 are folded on the hoop 55 and are welded to it by one of their ends.

In this particular embodiment, the locking of the slider in armed position is provided by a plunger 57 slidably mounted in a hollow 58 of the body 7 and pushed by a spring.

When the slider is in armed position, the peg 12 butts against the bottom of the hollow of spring 10, and the plunger enters hollow 17.

This plunger is held by a cover 59 of plastic material, which bears on a flat face of the body 7 and is made integral with it by rivets, not illustrated.

Figure 9:
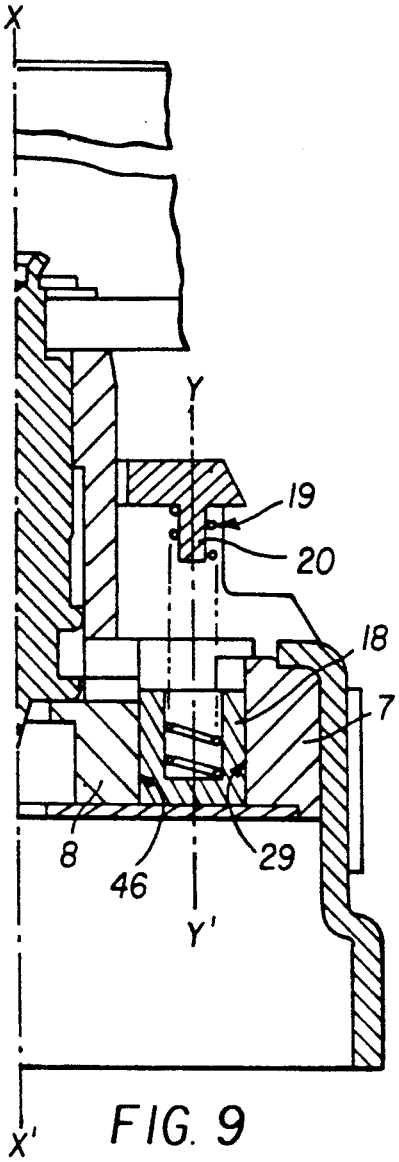
FIG. 9 is half-section of the device along plane F—F of FIG. 10, showing the acceleration safety.
Figure 8:
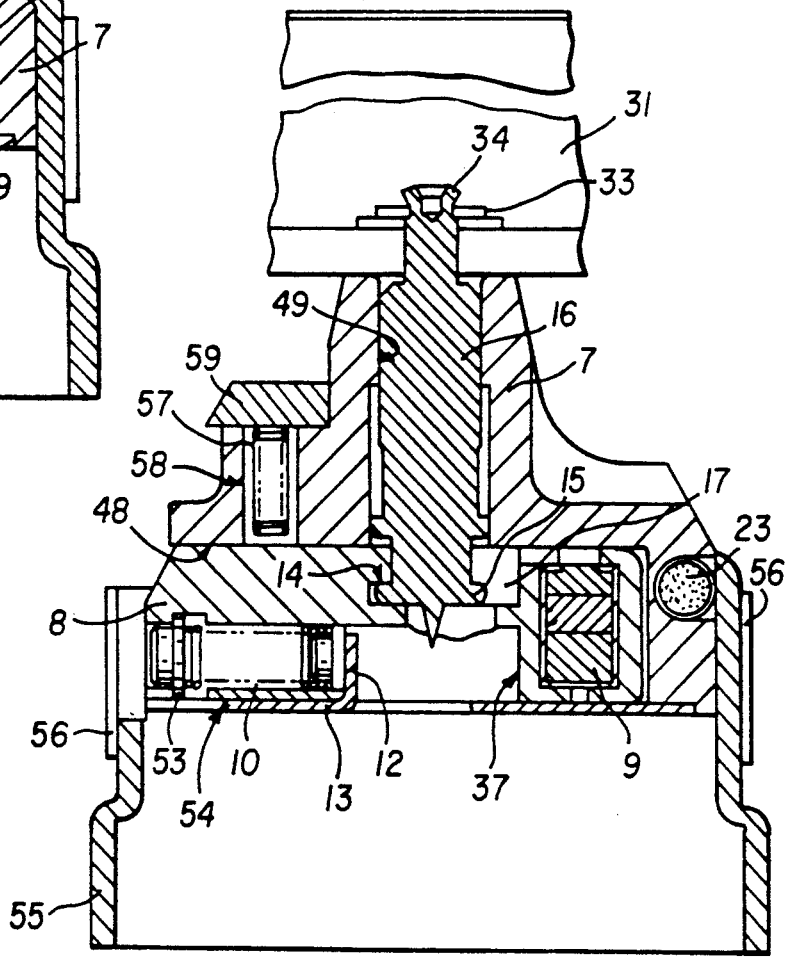
FIG. 8 is an axial section representing a second embodiment of the device along the plane D—D of FIG. 10.

The cover 59 also carries the pin 20, which guides the spring 19 of flyweight 18 (see FIG. 9). This flyweight constitutes the first blocking means of slider 8, as has already been described for the first embodiment.

Figure 10:
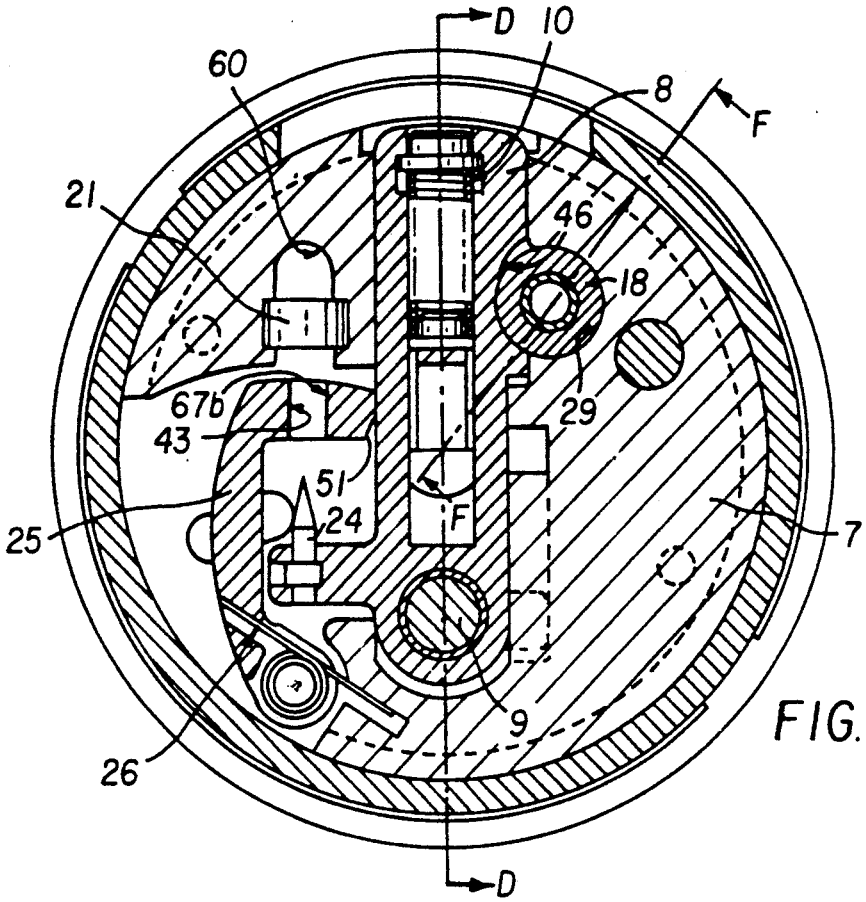
FIG. 10 is a cross section along plane G—G of FIG. 12.
Figure 11:
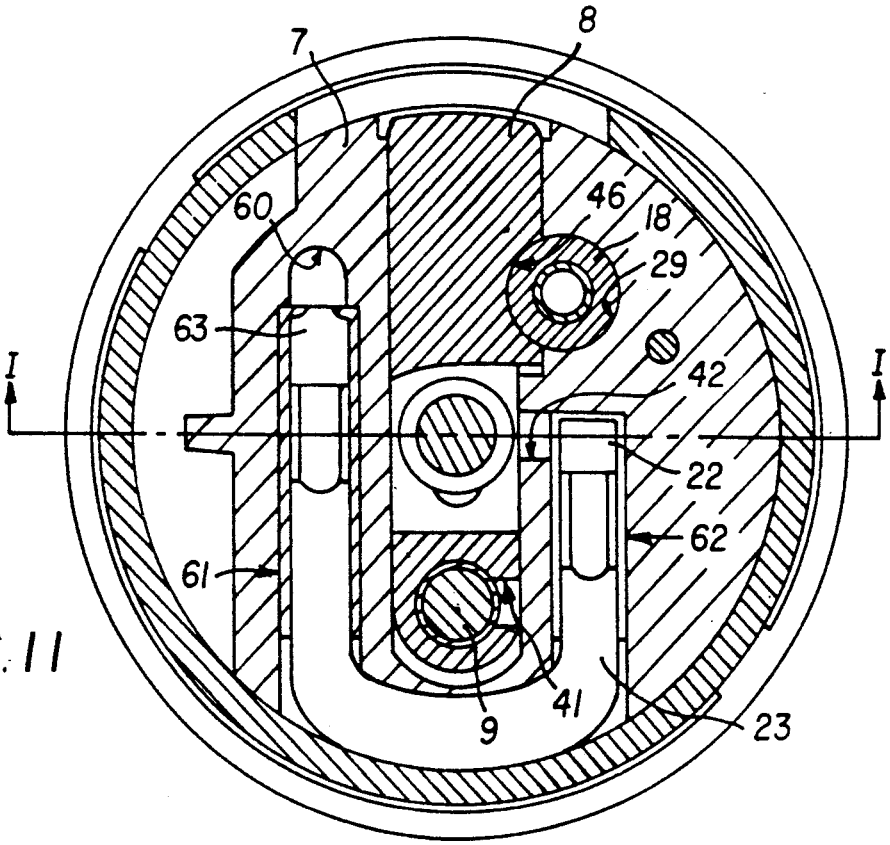
FIG. 11 is a section along the broken planes H—H of FIG. 12.
Figure 12:
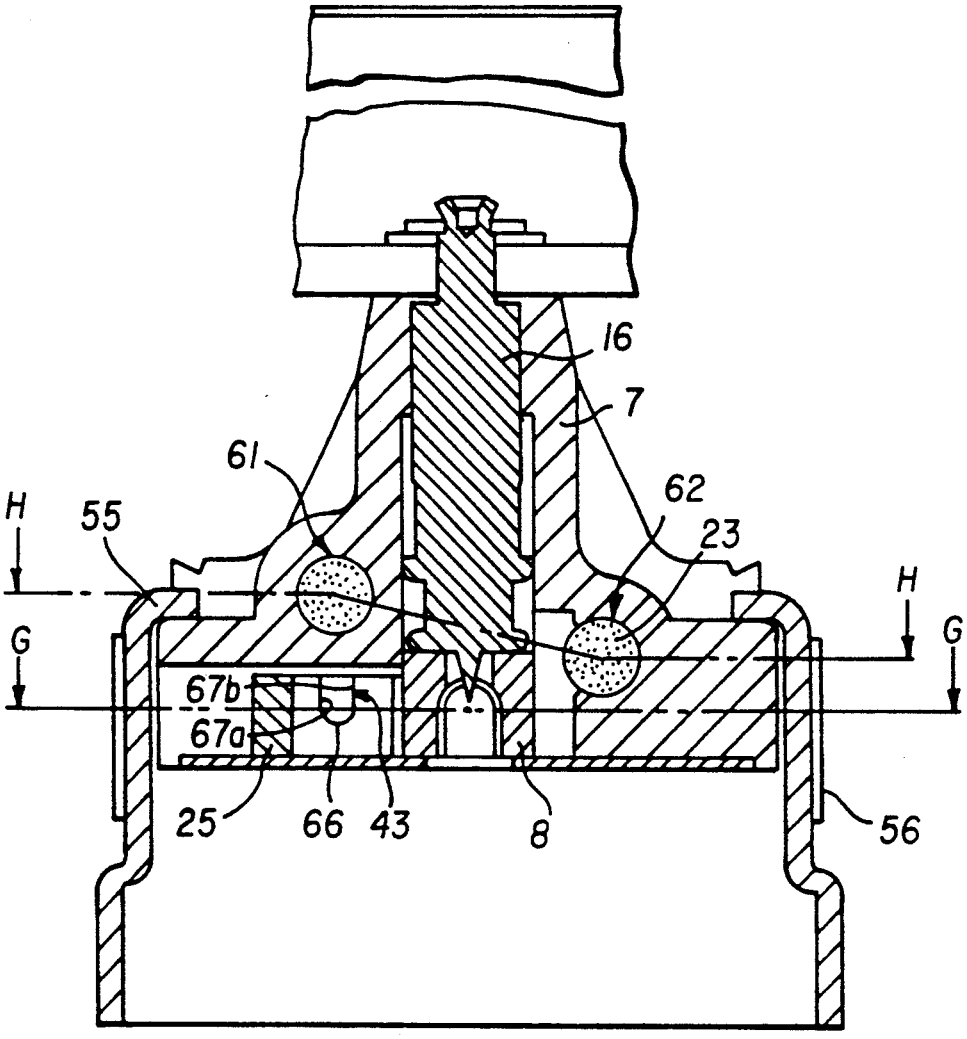
FIG. 12 is an axial section along plane I—I of FIG. 11.

FIGS. 10, 11 and 12 show the self-destruct device, which includes a striker 24 as before, integral with the slider 8, and a delay system consisting of a primer 21, an igniter relay 22 and a flexible delay wick 23 (see FIGS. 11 and 12).

In this particular embodiment, the primer is a percussion-sensitive inflammatory device that is not integral with the delay wick but which is fastened to the body 7 opposite the striker 24. A tube 60, arranged in the body 7, connects the inflammatory device to the delay wick 23.

Such an arrangement makes it possible to use a wick of reduced length and of a single curvature, which makes it easier to install on the body 7 by simple adjustement inside the parallel transverse bores 61 and 62, and guarantees the reliability of the transmission.

The flames produced by the initiation of the inflammatory device will be guided by the tube 60 and will initiate the delay wick 23 by means of a heat-or flamesensitive ignition composition 63 such as a known mixture of zirconium and barium chromate.

The igniter relay 22 will initiate the primer 9 through the openings 41 (on the slider 8) and 42 (on the body), and will do so only if the slider 8 is in armed position (FIG. 11).

The neutralization means (FIG. 10) as before consists of the centrifugal trigger 25 held in the safety position by the torsion spring 26. In this particular embodiment, the trigger includes a hollow at its end, but this hollow does not have a form complementary to that of the striker 24, and therefore cannot trap this striker.

The housing 43 is a notch made in the trigger 25, which is also visible in FIG. 12. It comprises a semi-cylindrical bottom surface 66 extended by two plane lateral surfaces 67*a* and 67*b* that are parallel to each other.

When the trigger 25 is in its safety position as shown in FIG. 10 and when, following an operation on the activating device, the slide mechanism 8 moves until it abuts on the trigger, the second striking pin 24 enters the housing 43 and thus prevents the trigger from moving away from the slide mechanism.

The trigger is no longer able to leave its safety position.

Figure 13:
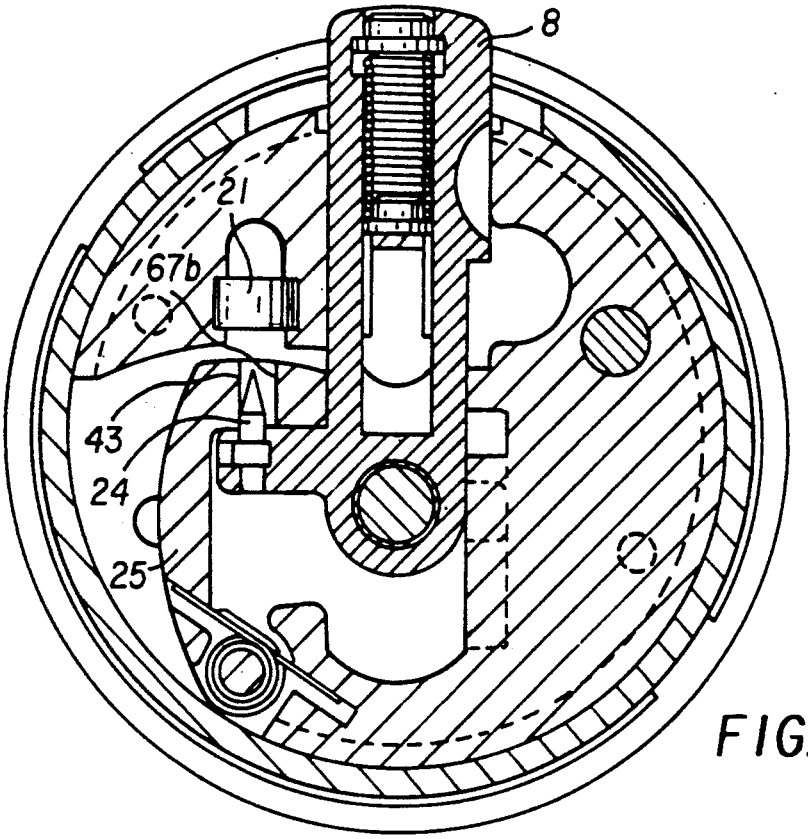
FIGS. 13–16 are other embodiments of the counterbalancing devices.

FIG. 13 shows the safety and arming device according to the invention when the slide mechanism 8 abuts on the trigger 25. The immobilization of the slide mechanism by the trigger and vice versa, provide an excellent degree of safety in the system.

In practice, in order for the slide mechanism to adopt an activated position, it would be necessary for:

the slide mechanism to be pushed back and held, countering the effect of its spring, the device to then be subjected to acceleration applied in a radial direction passing through the trigger, with this acceleration maintained for some time during which the slide mechanism would be released.

The probability of such a sequence of external events occurring is virtually zero.

It is possible to design safety and activating devices that do not comprise self destructing time delay devices but in which a trigger intervenes in the trajectory of the slide mechanism so that it prevents this from subsequently moving once it is in its armed position.

Figure 14:
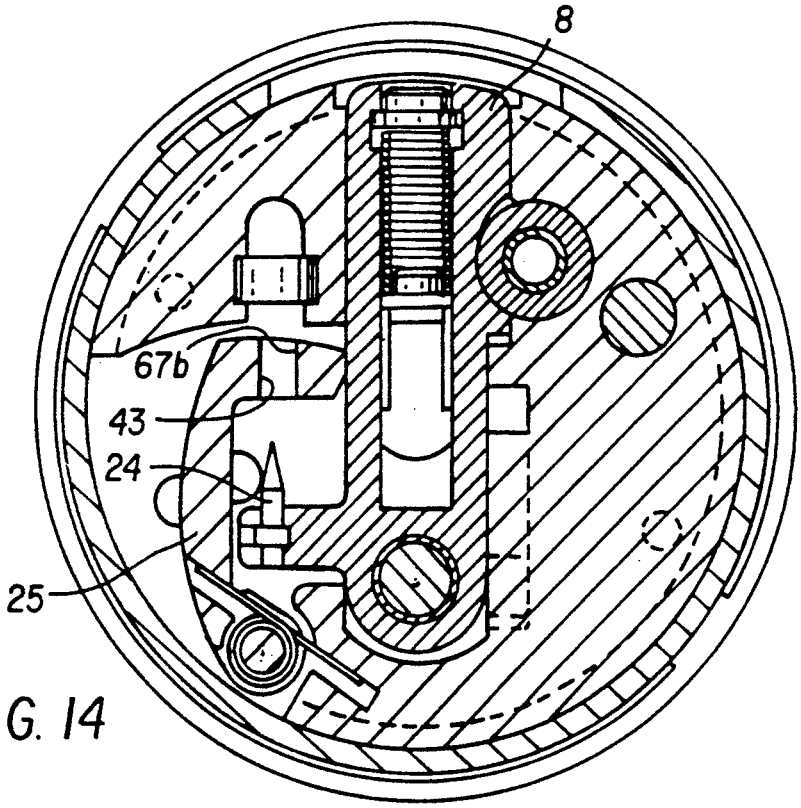

FIG. 14 shows a similar device to the one in FIGS. 8–12 but one in which the self-destructing devices have been removed (the second fuse 21, the activation relays 2 and the delay fuse 23).

The slide mechanism 8 still has a second striking pin 24. When the latter enters the housing 43 it prevents the trigger 25 from moving away form the slide mechanism.

In the latter example, it would be possible to replace the second striking pin with a part of a different shape but one which can enter the housing 43, for example, a cylindrical rod, mounted on the slide mechanism or made directly when this is being cast.

Figure 15A:
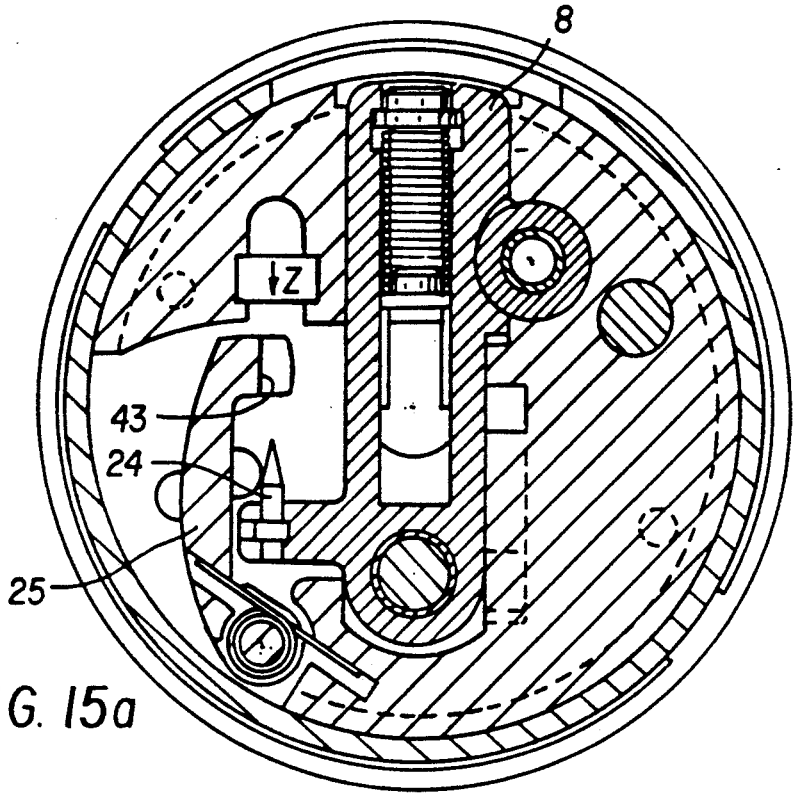

FIG. 15*a* shows a variant of the latter device in which the trigger 25 comprises, opposite the second striking pin 24 carried by the slide mechanism, a housing 43 that has a shape that complements that of the second striking pin 24 so that this is trapped when it enters the housing 43.

Figure 15B:
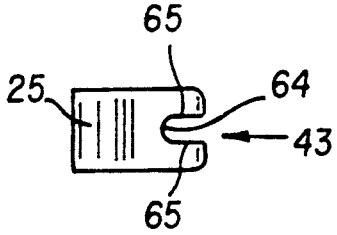

FIG. 15*b* shows a partial view of the end of the trigger in the direction Z of FIG. 15*a*, the housing 43 has a semi-cylindrical part 64 with a diameter slightly less (a few tenths of a millimeter) than that of the second striking pin 24 and two plane surface parts that are parallel with each other 65. The tapered end of the second striking pin facilitates its engagement in the housing 43.

It would also be possible to replace the second striking pin 24 with a cylindrical rod (mounted on the slide mechanism or made when this is being cast); the housing 43 would then be given a slightly tapered shaped so that the cylindrical rod engages in the housing 43.

The function of the second striking pin (or cylindrical rod) is to ensure immobilization by friction of the trigger 25 and the slide mechanism 8 relative to each other.

Figure 16:
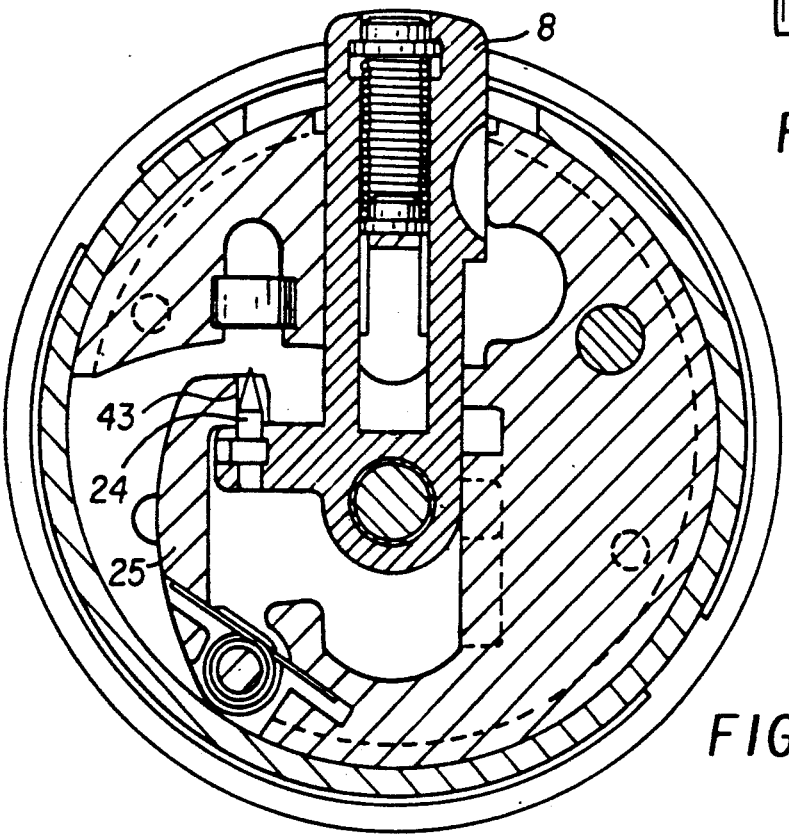

FIG. 16 shows a variant of FIG. 15*a* when the slide mechanism 8 is abutting on the trigger 25 and when the second striking pin has entered the housing 43.

The mutual immobilization of the slide mechanism 8 and trigger 25 provide an excellent degree of safety in the system.

We claim:

1. A pyrotechnic chain igniter device for cargo warhead sub-ammunition including an explosive charge contained in an enclosure, comprising:

a first striker mobile in a longitudinal bore of a body for striking a primer;

a slider carrying said primer, said slider being slidably mounted in a transverse groove in said body and being adapted for sliding between a safety position and an armed position, wherein said safety position is defined by said primer being misaligned with said first striker and said armed position is defined by said primer being substantially aligned with said first striker, and wherein said first striker is adapted for striking said primer when said slider is in said armed position and when said sub-ammunition impacts a target;

at least one means for blocking said slider in said safety position;

a trigger pivotally mounted to said body; and urging means for maintaining said trigger in a first position to prevent said slider from moving into said armed position, and for allowing said trigger to move to a second position upon axial rotary movement of the sub-ammunition thereby allowing said slider to move into said armed position, said urging means comprising a spring.

2. The device of claim 1, wherein said slider carries a second striker and said trigger forms a housing for accommodating said second striker when said trigger is in said first position, thereby preventing movement of said slider to said armed position.

3. The device of claim 2, wherein said housing is of complementary shape with respect to said second striker.

4. The device of claim 2, wherein said housing is shaped to prevent pivoting movement of said trigger when said second striker enters said housing.

* * * * *